US007462773B2

(12) United States Patent
Park et al.

(10) Patent No.: US 7,462,773 B2
(45) Date of Patent: Dec. 9, 2008

(54) METHOD OF SYNTHESIZING SOUND

(75) Inventors: Yong Chul Park, Seoul (KR); Yong Hee Lee, Seoul (KR); Jun Yup Lee, Yongin-si (KR)

(73) Assignee: LG Electronics Inc., Seoul (KR)

( * ) Notice: Subject to any disclaimer, the term of this patent is extended or adjusted under 35 U.S.C. 154(b) by 347 days.

(21) Appl. No.: 11/303,142

(22) Filed: Dec. 15, 2005

(65) Prior Publication Data

US 2006/0123979 A1 Jun. 15, 2006

(30) Foreign Application Priority Data

Dec. 15, 2004 (KR) ..... 10-2004-0106615

(51) Int. Cl.
*G10H 7/02* (2006.01)
*G10H 7/12* (2006.01)

(52) U.S. Cl. ..... 84/607; 84/603; 84/604

(58) Field of Classification Search ..... 84/603, 84/604, 607

See application file for complete search history.

(56) References Cited

U.S. PATENT DOCUMENTS

| | | | | |
|---|---|---|---|---|
| 5,315,057 | A | 5/1994 | Land et al. | |
| 5,659,466 | A * | 8/1997 | Norris et al. | 700/94 |
| 5,668,338 | A * | 9/1997 | Hewitt et al. | 84/629 |
| 5,808,220 | A * | 9/1998 | Yang | 84/601 |
| 6,100,461 | A * | 8/2000 | Hewitt | 84/603 |
| 6,138,224 | A * | 10/2000 | Lisle | 711/206 |
| 6,362,411 | B1 | 3/2002 | Suzuki et al. | |
| 6,365,817 | B1 | 4/2002 | Suzuki et al. | |
| 6,900,381 | B2 * | 5/2005 | Lindgren et al. | 84/603 |
| 7,088,835 | B1 * | 8/2006 | Norris et al. | 381/107 |
| 2003/0033338 | A1 * | 2/2003 | Lindgren et al. | 708/315 |
| 2005/0114136 | A1 * | 5/2005 | Hamalainen et al. | 704/258 |
| 2006/0086239 | A1 * | 4/2006 | Lee et al. | 84/645 |

* cited by examiner

*Primary Examiner*—David S. Warren
(74) *Attorney, Agent, or Firm*—Lee, Hong, Degerman, Kang & Waimey

(57) ABSTRACT

There is provided a method of synthesizing a musical instrument digital interface (MIDI) having wave table support. The wave table sample information is modified based on the newly searched loop segment, the interval of the newly searched loop segment, and the fine tune data. Therefore, the size of the wave table can be reduced.

20 Claims, 3 Drawing Sheets

METHOD OF SYNTHESIZING SOUND

This application claims the benefit of the Korean Patent Application No. 10-2004-0106615, filed on Dec. 15, 2004, which is hereby incorporated by reference as if fully set forth herein.

BACKGROUND OF THE INVENTION

1. Field of the Invention

The present invention relates to a method of synthesizing a musical instrument digital interface (MIDI) file using wave table.

2. Description of the Related Art

MIDI is a standard of representing musical data when synthesizing music. MIDI includes data on the type of musical instrument to be used, a pitch, a note duration, and other basic musical data, as well as data on how to represent the sound of the musical instrument. Methods of using musical data in MIDI format to produce actual synthesized sound are divided largely into frequency modulation (FM) synthesis and wave table synthesis. An FM synthesis method extracts frequency data of sounds that are made by each instrument, and creates signals for those frequencies in the synthesizing process. The wave table synthesis method precedent derives and stores a sample of sounds made by each musical instrument during a performance, and processes the stored samples for each instrument according to the musical data described in a MIDI file and synthesizes sound.

When synthesizing sound in the wave table method, actual sound samples of each instrument during a performance are used to modulate pitch, alter note lengths, and apply sound representations to create sound, based on musical data described in a MIDI file, such as pitch, note length, sound representation, etc. When acquiring and storing sound samples of musical instruments in a wave table, supplementary data such as change of volume of a sample sound over time, articulation data of small changes in frequency, the presence of a loop segment, a starting point of a loop segment, and length of a loop segment is stored. When the sounds are synthesized, the above data is reflected in the created sounds.

A wave table used for wave table sound synthesizing adopts a specific method for maintaining compatibility between various devices used for synthesizing. A common method is the downloadable sound (DLS) method. A DLS type wave table storage format regulates how sampling data of instruments and articulation data will be stored. For example, a sampling of an instrument can be designated to be stored in a WAVE format (which is an audio data storage format).

The process of synthesizing sound in a wave table method uses sound samples derived from each instrument during an actual performance and corresponding to a MIDI file or supplemental data of a wave table to recreate the sound. Here, when the sound samples taken from an actual performance are stored, the size of the wave table increases. However, the tendency of a performed note settling and repeating in a sustain section is utilized by a wave table so that when a sound source is stored, only signals in a section up to a point of repetition are stored. The repetitive section is called a loop segment, whose location in time and length are additionally stored. When a MIDI file is actually played, the loop segment is repeatedly played back. Depending on the characteristics of an instrument, a loop may be applicable or a playback may end with a one-shot sound. By using this loop segment, the size of a wave table can be reduced.

The process of synthesizing sound using a wave table method creates sound using performed sound samples of each instrument and supplementary data of a MIDI file or a wave table. Although it would be desirable for a wave table to include all the data corresponding to each sound in a MIDI file, because the size of the wave table would increase, the normal practice is to allot sounds of each instrument into a few segments and oscillate and use a sound in a segment to correspond to a note in the MIDI file. Even when using a loop segment, the storage space of a wave table is insufficient.

SUMMARY OF THE INVENTION

Accordingly, the present invention is directed to a sound synthesizer having wave table support that substantially obviates one or more problems due to limitations and disadvantages of the related art.

An object of the present invention is to provide a Sound synthesizing method that searches for a new loop segment of a sound sample in order to reduce the size of a sound sample used for the sound synthesizer having wave table support, restructures the wave table based on a newly-searched loop, and reduces the overall size of the wave table.

Another object of the present invention is to provide a sound synthesizing method that reduces the size of a wave table by shortening a loop segment and removing samplings following a loop segment by moving the position of the loop segment forward, and synthesize a distortion-free sound through searching of precise intervals.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided sound synthesizing method including: searching for a new loop segment based on a length and a loop segment length of a sound source sample stored in a wave table to reduce the loop segment length; searching for an interval of the searched loop segment; and rearranging the wave table using the searched loop segment and the interval.

In another aspect of the present invention, there is provided sound synthesizing method including: if a loop segment length of a sound source sample in a wave table is equal to or smaller than 1/N (where N is a positive integer) of a length of the sound source sample, selecting the sound source sample as a new loop segment searching object; searching a basic cycle and a zero-intersection point from the sound source sample and determining a new loop segment based on the searched zero-intersection point; searching an interval from a basic frequency obtained by performing a frequency conversion on the determined loop segment of the sound source sample; and rearranging the wave table using the determined loop segment and the interval.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
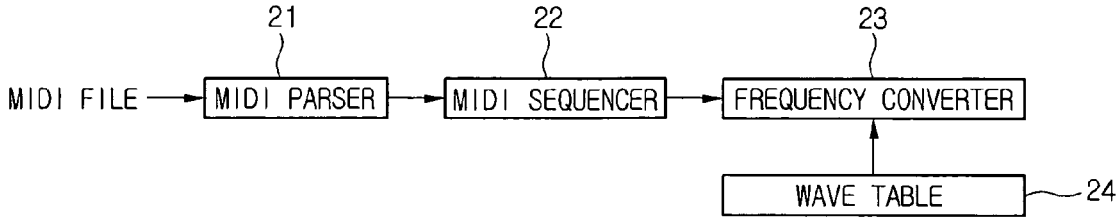
FIG. 1 is block diagram showing the structure of a MIDI playback device.

FIG. 1 is block diagram showing the structure of a MIDI playback device. A MIDI playback device includes a MIDI parser 21 for extracts a plurality of notes and note playback times from a MIDI file, a MIDI sequencer 22 for sequentially outputting the note playback times, a wave table 24 for recording at least one sound source sample, and a frequency converter 23 for using the at least one recorded sound source sample to perform a frequency conversion to a sound source sampling corresponding to each note each time a note playback time is outputted.

A MIDI file inputted in the MIDI parser 21, being data for a predetermined music that is stored in a storage medium, can include a plurality of notes and note playback times. As data representing a sound of a note, a MIDI file contains sound data for the notes "C", "D", and "E", for example. These notes are not actual sounds, but must be played back from actual sound sources. Also, the note playback times are the playback times of each of the plurality of notes included in the MIDI file, and are data on the duration of the sounds for the notes. For example, if a playback time for the note "D" is ⅛ second, a sound corresponding to the note "D" is played back for ⅛ second.

Sound sources by instrument and for each note of each instrument are registered in the wave table 24. Normally, there are 128 scales in music, and registering all the sound sources for these scales (that is, notes) in the wave table 24 is problematic. Thus, sound source samples for a selection of scales are registered.

When a note playback time is inputted in the frequency converter 23, it is determined if the sound source for the note exists in the wave table 24, and frequency is converted to the sound source for that note and outputted. An oscillator may be used as the frequency converter 23.

If the sound source for the note is found not to exist in the wave table 24, a predetermined sound source sample in the wave table 24 is read, and frequency conversion of the read sound source sample to a sound source sample corresponding to the note is implemented. If the sound source for the note exists in the wave table 24, the sound source is read from the wave table 24 and outputted, without a separate frequency conversion. For example, when a sound source sample registered in a wave table 24 is at 20 kHz, and the desired musical note is a sound source sample at 40 kHz, and frequency needs to be modified to 40 kHz to be played back, the sound source sample of 20 kHz can be converted by the frequency converter 23 to a sound source sample of 40 kHz and outputted.

This process is repeated each time a note playback time is inputted for each note.

Figure 2:
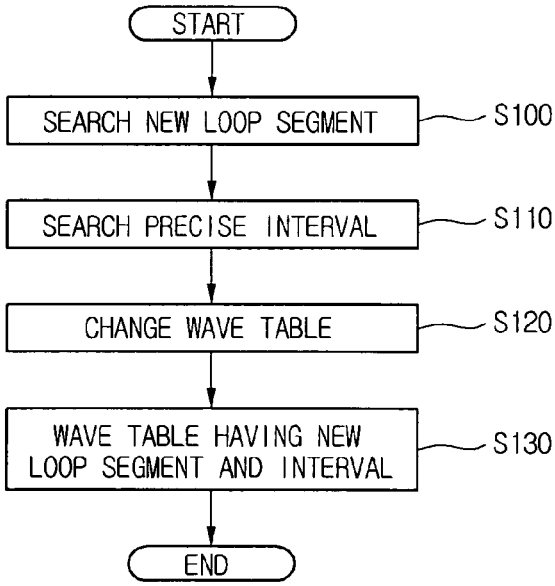
FIG. 2 is a flowchart showing a sound synthesizing method according to the present invention.

FIG. 2 is a flowchart showing a sound synthesizing method according to the present invention that illustrates the searching of a new loop segment according to an existing sound source sample, and finds a sound source for the searched loop segment.

In step S100, with a existing wave table as a basis, a new loop segment is searched based on the lengths of a sound source sample and a loop segment. An embodiment for a method of searching for a new loop segment will be described in detail below. When the length of a loop segment is more than half that of a sample, it is excluded from the search for a new loop segment, and when the length of a loop segment is less than half that of a sample, that sample is used as the basis for a new loop segment search. When a new loop segment is searched, data including a basic cycle (basic frequency) of a sound source, a maximum value of a sound source sample, a search for a zero intersection of sound source samples, and variation between sample values in the vicinity of the zero intersection are used.

When a new loop segment is searched, the interval of that loop segment is searched in step S110. For a precise search of the interval, a method is used in which the new loop segment is augmented, a window is applied to the augmented roof segment, frequency is converted based on the applied window and a base frequency is searched, and an interval for the base frequency is searched.

Next, the new loop segment and interval data are used to change the wave table in step S120. That is, data for the new loop segment that has a length less than that of the loop segment for the existing wave table sound source sample and the searched interval data are used as a basis to change the wave table values to derive the changed wave table according to the present invention. Finally, the wave table having the new loop segment and interval is completed in step S130.

Through this process, the storage space of a wave table requiring a large storage space in a sound synthesizing using a wave table can be reduced. That is, by pulling the loop segment including the instrument sampling forward from a previous location, the space used or storage is reduced, and a precise interval is searched based on the loop segment, to reduce the deviation of the sound quality when the MIDI is synthesized.

Figure 3:
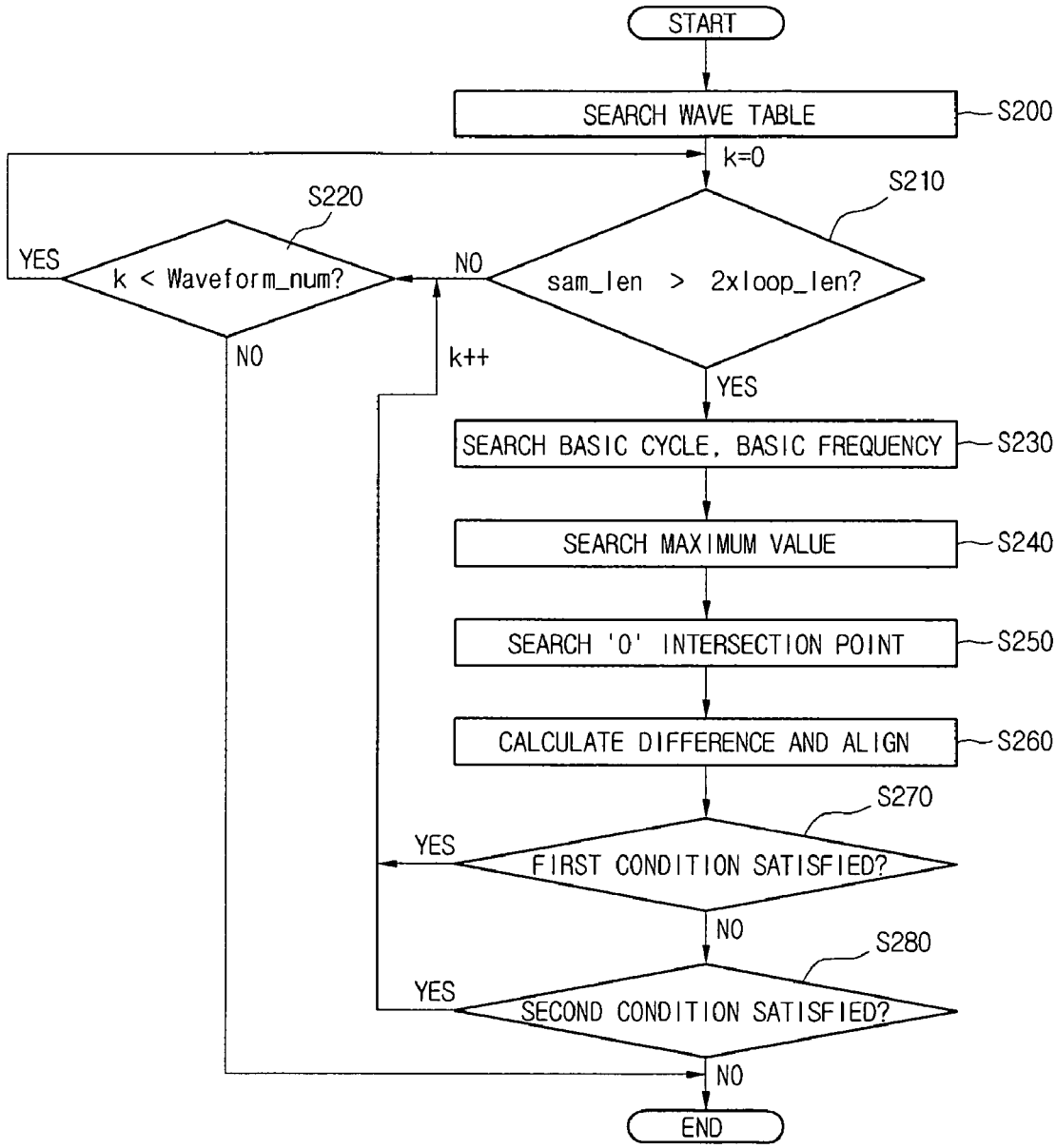
FIG. 3 is flowchart showing a process of searching for a new loop segment in the sound synthesizing method according to the present invention.

FIG. 3 is flowchart showing a process of searching for a new loop segment in the sound synthesizing method according to the present invention. FIG. 3 is a more detailed description of the process s100 shown in FIG. 2.

In step S200, an existing wave table that has not been changed is searched. An index k is given to each wave form searched in a wave table. Next, it is determined in step S210 if a new loop segment search should be performed, based on the length of a searched sound source sample and the length of a loop segment, or if it is to be omitted from a search for a new loop segment. Among sound sources stored in the wave table, a sound source with a loop longer than half of its length exhibits a abnormal wave form, causing a sound quality deviation when searching a new loop segment.

Thus, the lengths of the sound source sample and the loop segment are compared, and it is decided whether to search for a new corresponding loop segment. In other words, it is determined if the sample length (sam_len) is more than twice that of the loop length (loop_len), and if the sample length is less than twice that of the loop length, it is excluded from a search for a new loop segment, and if the sample length is more than twice that of the loop length, it is selected as a subject for a new loop segment search.

When the length of the sample in a wave table is less than twice that of the loop length, step S220 is implemented. In step S220, it is determined whether to continue the searching process for a new loop by comparing the index k with a waveform number (waveform_num). The waveform_num is stored in the existing wave table and signifies the number of sound sources from the sound sources with loops. Because the number of sound sources with loops cannot exceed the waveform_num, there is no need to search for new loops. Thus, when the index k value is larger than the waveform_num, new loop searches are stopped. When the index k value is smaller than the waveform_num, it signifies that there are other sound sources remaining in the wave table that can form loops, so that those sound sources are searched for in the wave table.

When the sample length exceeds the length of the loop by two times, the searching for a basic cycle (basic frequency) is begun in step S230. Sound sources included in the wave table form loops in a basic cycle or a multiple of a basic cycle, where the basic cycle of a sound source is $T=F_s/F_{rootkey}$. Here, $F_s$ is a sampling rate, $F_{rootkey}$ is a basic frequency of a sample for a root key value, where these values can be derived using supplementary data in the wave table. Using a basic cycle T of a sound source, a basic frequency value $\omega=2\pi/T$ can be obtained.

Next, in step S240, a maximum value (max_value) is searched from the sound source sample values. Due to the characteristics of the sound source, when a loop segment is searched from the starting point of the sound source, the sound source becomes unstable (having a value before it is stable). This can be solved by finding the maximum value of the sound source sample and selecting the loop starting point proximally after the maximum value. That is, supposing the maximum value of the sound source is a stable starting point of the sound source, this is considered when searching for the starting point of the loop.

Next, step S250 is a process for selecting the starting and ending points for the loop segment. Since a loop segment generally has a starting point and an ending point around a zero intersection point, the zero intersection point is searched using a basic cycle of the sound source or a multiple of the basic cycle that is obtained in step S230. Thus, the search range can be reduced.

In step S260, deviations of sample values derived before and after respective zero intersection points are calculated and sorted in an increasing order.

Here, the deviation Diff is expressed as follows:

$$Diff_{zn1,zn2} = \underset{k=-N}{\overset{N}{Q}} \sqrt{(zc_{n1-k} * zc_{n2-k})^2}$$

where $zc_{n1-k}$, $zc_{n2-k}$ denote sample values at a distance of K from the zero intersection, respectively. In this way, the sample differences are obtained, and an optimum loop segment with a minimum difference is selected.

In step S270, using a basic cycle T and a maximum value, a first condition for finding an optimum loop segment is presented. The first condition required in step S270 is as follows.

first_index ((max_value)*max_factor))<loop_start_index<(sam_len*endfactor)

In the first condition, the max_value is the maximum value of each sample in the wave table, and the max_factor is a ratio comparing the maximum values to determine how large the sample portion is. That is, the max_factor represents the searching starting point with respect to the maximum value. The first_index (X) denotes an index where X initially appears from the indexes of the wave table samples. The loop_start_index denotes the starting point for the loop to be found, and the sam_len denotes the respective lengths of the wave tables. Also, the endfactor denotes represents a proper limit of the loop with respect to a sound source sample length. Accordingly, the first condition multiplies the max_value with the max_factor and selects sample portions having a value higher than the multiplied value as the loop starting points, which means that the loop starting points are selected within predetermined ratios inputted by a user from the lengths of the sound source samples.

If the first condition is not fulfilled, it is determined whether a second condition can be fulfilled in step S280. The second condition in required in step S280 is as follows.

first_index((max_value)*max_factor))

Specifically, it is determining whether the index is one where (max_value)*max_factor initially appears from the indexes of the wave table samples.

When both the conditions in steps S270 and S280 are not fulfilled, existing loop segments are used. However, when one of the conditions in steps S270 and S280 are fulfilled, relevant loop segments are designated as new loop segments, and after new loops are obtained, the above-described search for new loop segments is resumed in step S220 based on existing sound sources stored in the wave table.

Figure 4:
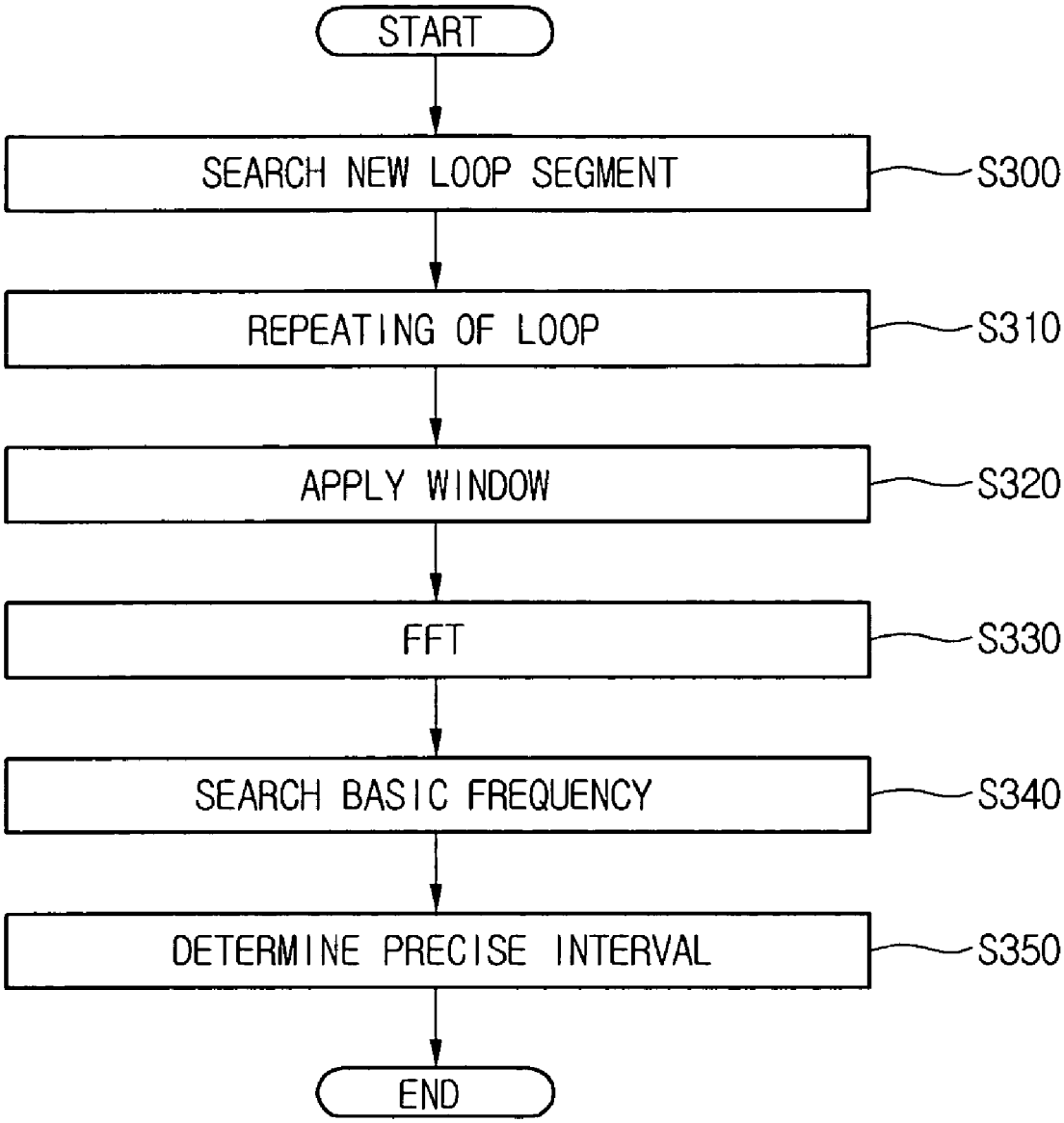
FIG. 4 is a flowchart showing a process of searching for an interval in the sound synthesizing method according to the present invention.

FIG. 4 is a flowchart showing a process of searching for an interval in the sound synthesizing method according to the present invention. FIG. 4 shows step S110 in more detail than FIG. 2. When new loop segments are searched in an existing table, the positions of the loop segments shift so that slight differences of intervals can be formed when compared to existing sound sources. Accordingly, in order to obtain a precise basic frequency for samples of the new loop segments, expansion of the samples (loop repetition) and application of windows are implemented to perform an FFT (Fast Fourier Transform).

In step S300, new loop segments are searched. In order to find the precise frequency characteristics of sound sources of the new loop segments, the loop segment repetition is used for expansion in step S310. Through step S310, more samples can be obtained than the original sound sources.

That is, when a signal is converted, a frequency of 0.01 Hz or higher is considered as a distinguishable frequency between maximally neighboring frequency components. When the length of the loop segment is only around 5-6 according to the basic frequency of the sound source, because there are too few samples, even if an FFT were performed, the designation of basic frequencies is difficult, so that an expansion of the samples are needed.

In order to find precise frequencies, a window is applied in step S320. After a loop segment of a sound source is expanded, if the sound source were to simply undergo an FFT, the frequency characteristics cannot properly be shown due to the discontinuity of the samples, so that a window is applied.

After the window is applied, a time region signal is converted to a frequency region through the FFT in step S330, and then a basic frequency is searched in step S340. Finally, a relevant precise sound source is searched for in step S350, based on the searched basic frequency. The new loop segments thus found for the respective sound sources and precise intervals are used to change the data of a wave table and form a new wave table.

However, even if interval values for loop segments are obtained through a searching for precise sound sources for new loop segments, it is difficult to use the values right away. This is because in sound synthesizing, performing is done using sound sources of a wave table with sound data of the MIDI file. Here, the relevant sounds of the MIDI file are compared to root key and fine tune values for sound sources of the wave table, and oscillation for the amount of difference is implemented in the performing.

For example, if the actual interval of a wave table sound source is C5+10, and C5 is set as the root key value of the wave table sound source and a fine tune value is set at −10, when the C5 note is performed in the MIDI file, the C5 can be precisely represented since a note of C5+10 is oscillated at a difference of '10'. Here, the +10 and −10 values are in cent units, where 1 cent 1200 $\log_2(F_1/F_2)$. Here, $F_1$ and $F_2$ are frequencies. That is, one octave, which represents a two-fold difference of frequency is applicable to 1200 cents. Through this fine tune process, when actual notes of a MIDI file are represented as sound, there is no deviation in sound quality.

In this way, the wave table sample information is modified based on the newly searched loop segment, the interval of the newly searched loop segment, and the fine tune data. Therefore, the new loop segment, when compared to existing loop segments of a wave table, are shorter in length and are pulled forward in time so that sound source samples that are no longer required can be discarded. Subsequently, the size of the wave table can be reduced.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A sound synthesizing method using a wave table having sound source samples and at least a first loop segment, the method comprising:

searching for a second loop segment based on length of the first loop segment and length of a sound source sample in the wave table, wherein the length of the second loop segment is shorter than the length of the first loop segment;

searching for a musical interval of the first loop segment; and including the second loop segment in the wave table such that sound can be synthesized using the second loop segment.

2. The method according to claim 1, wherein the searching for the second loop segment is implemented based on a result of a comparing the length of the sound source sample and the length of the first loop segment.

3. The method according to claim 1, wherein if the length of the first loop segment is more than a half of the length of the sound source sample, the first loop segment is excluded from the searching for the second loop segment.

4. The method according to claim 1, wherein if the length of the first loop segment is less than a half of the length of the sound source sample, the searching for the second loop segment is performed.

5. The method according to claim 1, wherein the searching for the second loop segment comprises reducing a loop segment searching range based on a basic cycle of the sound source.

6. The method according to claim 1, wherein the searching for the second loop segment comprises reducing a loop segment searching range based on a multiple of a basic cycle of the sound source.

7. The method according to claim 1, wherein the searching for the second loop segment comprises selecting a start position of a searching range based on a maximum value of the sound source sample.

8. The method according to claim 1, wherein the searching for the second loop segment comprises selecting an intersecting point of the sound source sample value at zero as a starting point and an ending point of the first loop segment.

9. The method according to claim 1, wherein the searching for the second loop segment comprises determining the second loop segment by searching an intersecting point of the sound source sample value at zero from a basic cycle of the sound source or a multiple point of the basic cycle.

10. The method according to claim 1, wherein the searching for the second loop segment comprises determining the second loop segment based on a deviation of sample values around an intersecting point of a sound sample value at zero.

11. The method according to claim 1, wherein the searching for the second loop segment comprises determining the second loop segment based on a deviation of sample values, the sample values being obtained before and after a zero-intersection point corresponding to a basic cycle of the sound source or a multiple of the basic cycle.

12. The method according to claim 1, wherein the searching for the interval is performed by expanding the first loop segment.

13. The method according to claim 1, wherein the searching for the interval is performed by applying a window to an expanded loop segment.

14. The method according to claim 1, wherein the searching for the interval is performed by searching for a basic frequency after applying a window to an expanded loop segment and performing a frequency conversion on the expanded loop segment.

15. The method according to claim 1, further comprising performing a fine tune on the searched interval.

16. The method according to claim 1, the wave table is modified by modifying sample information stored in the wave table based on the second loop segment, the interval of the second loop segment, and a fine tune of the interval.

17. A sound synthesizing system comprising:

a wave table having sound source samples and at least a first loop segment;

a logic unit for searching for a second loop segment based on length of the first loop segment and length of a sound source sample in the wave table, wherein the length of the second loop segment is shorter than the length of the first loop segment;

a logic unit for searching for a musical interval of the first loop segment; and a logic unit for including the second loop segment in the wave table such that sound can be synthesized using the wave table as modified.

18. The system according to claim 17, wherein the searching for the second loop segment is implemented based on a result of a comparing the length of the sound source sample and the length of the first loop segment.

19. The system according to claim 17, wherein if the length of the first loop segment is more than a half of the length of the sound source sample, the first loop segment is excluded from the searching for the second loop segment.

20. The system according to claim 17, wherein if the length of the first loop segment is less than a half of the length of the sound source sample, the searching for the second loop segment is performed.

* * * * *